United States Patent [19]

Dankowski et al.

[11] Patent Number: 4,879,057

[45] Date of Patent: Nov. 7, 1989

[54] AQUEOUS BLEACHING AGENT SUSPENSIONS CONTAINING PEROXYCARBOXYLIC ACID, METHOD FOR THEIR PREPARATION AND USE

[75] Inventors: Manfred Dankowski, Mömbris; Thomas Lieser, Hanau; Günter Prescher, Hanau; Wolfgang Leonhardt; Manfred Diehl, both of Frankfurt, all of Fed. Rep. of Germany

[73] Assignee: Degussa Aktiengesellschaft, Frankfurt/Main, Fed. Rep. of Germany

[21] Appl. No.: 168,997

[22] Filed: Mar. 16, 1988

[30] Foreign Application Priority Data

Mar. 21, 1987 [DE] Fed. Rep. of Germany ..... 3709348

[51] Int. Cl.[4] ..... C11D 7/18; C11D 7/38; C11D 7/56

[52] U.S. Cl. ..... 252/99; 252/95; 252/186.25; 252/186.26

[58] Field of Search ..... 252/186.26, 186.25, 252/99, 95

[56] References Cited

FOREIGN PATENT DOCUMENTS 3607673 9/1987 Fed. Rep. of Germany .

*Primary Examiner*—Paul Lieberman
*Assistant Examiner*—John F. McNally
*Attorney, Agent, or Firm*—Cushman, Darby & Cushman

[57] ABSTRACT

Aqueous bleaching agent suspensions based on a water-soluble peroxycarboxylic acid suspended in a carrier liquid in the presence of an organic thickening agent and of an acidifying agent exhibit an improved storage resistance over known suspensions with this base. This is achieved by means of pourable to pasty bleaching agent suspensions which contain a xanthan polysaccharide or agar polysaccharide as thickening agent and, in addition, a hydrate-forming neutral salt which desensitizes peroxycarboxylic acids. Preferred suspensions exhibit a pH of 2–5 and contain 10–30% by wt. diperoxydodecanedioic acid, 5–20% by wt. sodium sulfate and 0.1–1.0% by wt. xanthan. The use of non-dried, hydrophilized and optionally in situ desensitized peroxycarboxylic acids is especially preferred.

The bleaching agent suspensions are prepared by homogeneously suspending the peroxycarboxylic acid in the thickened carrier liquid.

The storage-resistant bleaching agent suspensions are used as laundry bleaching agents and for preparing cleaning agents and disinfection agents.

22 Claims, No Drawings

AQUEOUS BLEACHING AGENT SUSPENSIONS CONTAINING PEROXYCARBOXYLIC ACID, METHOD FOR THEIR PREPARATION AND USE

The present invention relates to storage-resistant, pourable-to-pasty aqueous bleaching agent suspensions. The suspensions have a pH between approximately 1 and 6 and contain a substantially water-insoluble peroxycarboxylic acid, preferably a diperoxydicarboxylic acid which has 8 to 18 carbon atoms hydrophilized in the presence of a strong acid and in a carrier liquid thickened with selected polysaccharides. The invention also relates to a reliable method for preparing such bleaching agent suspensions as well as to their use for purposes of bleaching and disinfection.

BACKGROUND OF THE INVENTION

Aqueous bleaching agent suspensions containing peroxycarboxylic acids are known from British Patent No. 1,535,804, corresponding to U.S. Pat. Nos. 3,996,1522 and 4,017,412. Such bleaching agent compounds can be added with advantage to alkaline washing mixtures in washing machines or be used themselves as bleaching agents.

The use of bleaching agent suspensions, in comparison to solid, generally particulate bleaching agent compounds, has the advantage of being able to eliminate expensive and, in the case of peroxycarboxylic acids, drying and granulating steps which have reliability problems. However, in addition to being effective in use, bleaching agent suspensions must satisfy certain essential conditions which are needed for smooth and reliable handling in the commercial and domestic areas. These conditions include, good chemical stability and especially physical stability as regards a solid liquid phase separation and handling safety, even in the event of leakage or spaying of the suspension from barrels.

The aqueous bleaching agent compounds according to British patent No. 1,535,804 contain essentially water-insoluble peroxycarboxylic acids which are suspended in an aqueous carrier liquid containing a thickening agent. These compounds are thickened until gelled and their viscosity is 200 to 100,000 centipoises. Starches, cellulose derivatives, natural rubbers, synthetic organic polymers as well as inorganic thickening agents of the group of colloidal silicic acids and hydrophilic clays are mentioned as thickening agents.

A major disadvantage of the bleaching agent compounds of British Patent Patent No. 1,535,804 is that they usually have insufficient storage resistance, at least to the extent that they are not gelled systems. The suspensions are physically unstable, since the solid phase separates from the liquid phase. This instability usually becomes noticeable directly after preparation of the suspension, frequently within one day or even hours. On the other hand, experts in this field call for greater storage resistance, preferably one of several weeks.

Another disadvantage caused by the physical instability with phase separation concerns the redispersibility of the thickened phase containing the peroxycarboxylic acid, which is unacceptably difficult. Finally, bleaching agent suspensions prepared with organic thickening agents present an increased potential for danger because, after a suspension has been spilled, and especially after the spilled material has dried, substantially non-desensitized peroxycarboxylic acid remains. Attempts to reduce the potential for danger by adding a desensitizing agent such as sodium sulfate were not successful because the properties of the suspensions deteriorated even more, cf published European Patent Application No. 0,176,124, page 2, paragraph. 1 and European Patent Application No. 0,160,342, page 3, paragraph 3. There has been no lack of attempts to create bleaching agent suspensions with improved storage resistance and a lesser potential for danger. Thus, European Patent Application No. 0, 160,342 teaches aqueous bleaching agent suspensions in which water-insoluble peroxy acids are suspended in an aqueous liquid containing a surfactant and an electrolyte. These pourable suspensions preferably contain sodium sulfate as well as an anionic and/or nonionic surfactant. A considerable disadvantage of these systems, namely, the very limited chemical stability, was eliminated by the use of alkali metal salts of alkyl benzene sulfonic acids, cf. European Patent Application No. 0,176,124 or by adjusting the pH to the range 3.5 to 4.1, cf. EP-A- 0,201,958. However, the physical stability of these surfactant-structured bleaching agent suspensions does not satisfy the requirements for such systems, as is shown in reference examples.

Thus, the need for a bleaching agent suspension which is sufficiently stable from a chemical and a physical standpoint has not been satisfied by the previously known thickening agent systems or surfactant-structured systems.

SUMMARY OF THE INVENTION

The object of the present invention is to provide pourable to pasty aqueous bleaching agent suspensions which have increased storage stability. More specifically, the object is to provide systems which exhibit practically no solid/liquid phase separation and only a slight loss of available oxygen, even after two weeks of storage. Another object of the present invention is to provide a method for preparing such suspensions which can be performed in an industrially simple manner and which preferably permits the use of non-dried, optionally densensitized peroxycarboxylic acids.

These objects are achieved with a pourable to pasty, aqueous bleaching agent suspension having a pH between approximately 1 and approximately 6 containing an aqueous carrier liquid, a particulate, practically water-insoluble peroxycarboxylic acid, an organic thickening agent and an acidifying agent, which is characterized in that it contains a xanthan polysaccharide or agar polysaccharide as thickening agent and a hydrate-forming neutral salt which desensitizes peroxycarboxylic acids.

The bleaching agent suspensions of the invention can be both pourable as well as pasty. The viscosity customarily increases as the concentration of thickening agent increases and as the amount of suspended peroxycarboxylic acid increases. The suspensions thickened with xanthan polysaccharides or agar polysaccharides, but especially with xanthan polysaccharides, exhibit a pseudoplastic behavior. That is, after the liquid limit has been exceeded, they flow more readily under the action of shearing gradients. Shearing forces such as those which occur during pouring or those which occur during a manual pressing of a paste from a tube are sufficient to render the suspensions flowable.

Preferred bleaching agent suspensions in accordance with the invention exhibit a structurally viscous and partially weakly thixotropic behavior; their liquid limit can be in a range of approximately 0.5 to 50 Pa., their viscosity, measured at 20° C. in a rotational viscosimeter at a shearing speed of 50/s, approximately 20 to 2000 mPa.s. Suspensions with 50 to 100 mPa.s at 50/s and a liquid limit of approximately 2–20 Pa. are especially preferred.

Bleaching agent suspensions in accordance with the invention with good storage resistance exhibit practically no signs of a phase separation even after two weeks of storage. A slight phase separation may occur in the course of several weeks in rare instances, but this is not disadvantageous because the suspension can be readily rehomogenized e.g. by means of a slight agitation for exceeding the liquid limit. Good chemical stability is present if the available oxygen loss after four to six weeks of storage at room temperature is under 5% in relation to the available oxygen content determined after preparation of the suspension.

The carrier liquid for the practically water-insoluble peroxycarboxylic acids consists of 90–100 % by weight water and 0–10% by weight of an organic solvent, each in relation to the carrier liquid. Water-soluble organic solvents, e.g. lower alcohols, can be used provided that the peroxycarboxylic acids are essentially not dissolved in the carrier liquid. Water is preferred as carrier liquid.

The bleaching agent suspensions of the invention contain one or more particulate peroxycarboxylic acids which are substantially water-insoluble, i.e., which have a solubility in water of under 1 g per 100 ml water. Solid peroxycarboxylic acids which exhibit a melting or breakdown point above 40° C. are suitable. The grain size of the peroxycarboxylic acids can be between approximately 1 and 500 μm, preferably 4–100 μm. A close distribution of grain size is usually advantageous, even as regards usage.

Water-insoluble, aliphatic or aromatic peroxycarboxylic acids with one, two or, if necessary, three peroxycarboxylic acid groups can be used. The peroxycarboxylic acids can also contain a sulfonic acid group. Aliphatic peroxycarboxylic acids with 6 to 18 carbon atoms and aromatic peroxycarboxylic acids with 7 to 14 carbon atoms are suitable. Aliphatic or aromatic diperoxydicarboxylic acids with 8 to 18 carbon atoms are preferred, e.g. diperoxyazelaic acid, diperoxydodecanedioic acid, diperoxysuccinic acid which is substituted in the 2-position with a $C_6$ to $C_{12}$ alkyl group of diperoxyglutaric acid which is substituted in the 2-position with a $C_6$ to $C_{12}$ alkyl group, as well as diperoxyphthalic acids and diperoxynaphthalene dicarboxylic acids. Diperoxydodecanedioic acid is especially preferred. The bleaching agent suspensions can contain one, two or more peroxycarboxylic acids, but they preferably contain one peroxycarboxylic acid.

The bleaching agent suspensions contain 1–40% by weight, preferably 5–30% by weight and quite particularly 15–30% by weight peroxycarboxylic acid in relation to the bleaching agent suspension.

It was unexpectedly found that, of the plurality of organic thickening agents known from British Patent 1,535,804 for preparing bleaching agent suspensions, only xanthan polysaccharides and agar polysaccharides, are suitable for preparing the storage-resistant bleaching agent suspensions of the invention. Of these, the xanthan polysaccharides are to be preferred. The organic thickening agents such as starches, cellulose derivatives or carboxypolymethylene preferred according to British Patent No. 1,535,804 did not result in any sufficiently storage resistant bleaching agent suspensions. Even the natural gums mentioned, but not preferred, in British Patent No. 1,535,804, e.g. gum arabic, proved to be completely unsuitable, as follows from reference examples, since bleaching agent suspensions prepared with them are storage-resistant for hardly one to two hours. In addition, it could not have been expected that precisely xanthan polysaccharides and agar polysaccharides in the presence of a hydrate-forming neutral salt which desensitizes peroxycarboxylic acids would result in especially storage-resistant bleaching agent suspensions. Neutral salts in the presence of thickening agents other than those added in accordance with the present invention generally result, as is already known, in deterioration of the stability of the suspension.

Xanthan is a high-molecular polysaccharide obtainable by fermentation whose basic components are mannose, glucose and glucuronic acid, partially as the sodium salt, potassium salt or calcium salt. The agar polysaccharides - agar contains agarose and agaropectin - stem from certain red algae. The bleaching agent suspensions contain 0.01 to 5% by weight, preferably 0.05 to 2% by weight, and in an especially preferred manner, 0.1 to 1% by weight, xanthan, each in relation to the bleaching agent suspension, or 0.05–0.5% by weight agar. If necessary, other inorganic or organic thickening agents compatible with xanthan or agar as well as with the other components of the bleaching agent suspension can also be used in addition; however, xanthan is preferably added alone.

The bleaching agent suspensions of the invention contain a hydrate-forming neutral salt in an amount of approximately 1 to approximately 40% by weight, preferably 2 to 20% by weight, calculated hydrate-free and in relation to the suspension, or the purpose of increasing the storage resistance of the suspension and desensitizing the peroxycarboxylic acid. In relation to the peroxycarboxylic acid, the amount of neutral salt, calculated as above as hydrate-free neutral salt, is generally 10 to 400% and preferably 20 to 100% by weight. An amount of neutral salt below 10% by weight in relation to the peroxycarboxylic acid is possible; however, this reduces the handling safety. The neutral salt is present in the bleaching agent suspension in partially or completely dissolved form. Preferred bleaching agent suspensions contain a part of the neutral salt, optionally as a hydrate thereof, in undissolved form at a customary storage temperature of 20° C. The viscosity of the bleaching agent suspension generally increases as the amount of hydrate-forming neutral salt present increases; this increase of viscosity has an advantageous effect on the physical stability of the suspension. Thus, the amount of xanthan or agar in the suspension can be reduced, if desired, with retention of the viscosity if the amount of neutral salt is increased.

Advantageous hydrate-forming neutral salts are those of alkali metals, of magnesium or of aluminum with sulfuric acid, pyrosulfuric acid, phosphoric acid, pyrophosphoric acid or tripolyphosphoric acid. Alkali metal sulfates, particularly sodium sulfate are especially preferable. Various hydrate-forming neutral salts can also be present at the same time.

The pH of the bleaching agent suspensions of the invention is between approximately 1 and approximately 6 and preferably between 2 and 5. The chemical stability of the peroxycarboxylic acids decreases at pH'es around or above 6. The acidifying agent necessary for adjusting the pH can be a strong, inorganic acid such as sulfuric acid or phosphoric acid compatible with peroxycarboxylic acids, a strongly acidic salt such as sodium hydrogen sulfate or sodium dihydrogen phosphate or a storng organic acid such as methane sulfon ic acid, citric acid or tartaric acid. Sulfuric acid and/or alkali metal hydrogen sulfate are especially preferable.

It was surprisingly found that the storage resistance of bleaching agent suspensions of the invention is especially good if they contain hydrophilized peroxycarboxylic acid in the presence of a strong acid. The wettability of the not very hydrophilic, water-insoluble peroxycarboxylic acids by the aqueous carrier liquid is obviously improved by the fact that the peroxycarboxylic acid comes in direct contact with a strong acid, preferably sulfuric acid, during or after its preparation. Such hydrophilized peroxycarboxylic acids are obtainable e.g. from the base carboxylic acid or its anhydride and hydrogen peroxide in the presence of sulfuric acid according to a method according to U.S. Pat. No. 4,244,844, German Patent Specification DE-OS No. 33 20 497 and German Patent Specification DE-OS No. 34 38 529 or in the form of the in situdesensitized products according to U.S. Pat. No. 4,287,135, German Patent Specification DE-OS No. 3,220,496 and European Patent Application No. EP-B 0,045,290. The acidifying agent present in the bleaching agent suspension can stem entirely or partially from the hydrophilizing and/or in situdensensitizing of the peroxycarboxylic acid, the hydrateforming neutral salt entirely or partially from the densensitizing.

It was further found in a completely unexpected manner that a moist hydrophilized peroxycarboxylic acid, i.e., one which has not been dried after its preparation, imparts a greater physical stability to the bleaching agent suspensions which contain it than a dried hydrophilized peroxycarboxylic acid does. Obviously, the surface structure of hydrophilized peroxycarboxylic acids is changed in an unfavorable manner by drying. The use of non-dried, optionally in situ-densensitized, peroxycarboxylic acids in the preparation of the bleaching agent suspensions of the invention is especially useful because an industrially expensive drying of the peroxycarboxylic acid, which is questionable as regards safety, is eliminated, and suspensions with a better storage resistance are obtained.

According to a preferred embodiment, the suspensions contain 10–30% by weight diperoxydodecanedioic acid, 5–20% by weight sodium sulfate and 0.1 to 1% by weight xanthan, each in relation to the bleaching agent supension, and sulfuric acid and/or sodium hydrogen sulfate as acidifying agent. The best storage resistance of these suspensions is obtained by using a non-dried diperoxydodecanedioic acid which has been hydrophilized during preparation by means of sulfuric acid and subsequently desensitized by means of the addition of sodium hydroxide with formation of sodium sulfate.

In addition to the constitutes of the bleaching agent suspensions of the invention discussed above, the latter can contain other substances compatible with them in order to optimally adapt the bleaching agent suspensions to the particular application intended. In general, the amounts to be added for this purpose are small in relation to the peroxycarboxylic acid and the neutral salt. Typical additives are:

Neutral densitizing means other than hydrate-forming ones, e.g. acidic densensitizing substances such as hydrogen phosphates, diphydrogen phosphates, boric acid or silicic acid.

Chelate complexing agents for complexing metal ions with a decomposing action and for improving the chemical stability of the suspended peroxycarboxylic acids. Examples of such complexing agents are ethylene diamine tetraacetic acid, diethylene triamine pentaacetic acid, preferably 2-hydroxyethylidene diphosphonic acid, ehtylene diamine tetra(methylene phosphonic acid) or diethylene triamine penta(methylene phosphoric acid).

Stabilizers such as dipicolinic acid or trialkyl phosphane oxides.

Anionic and/or non-ionic surfactants, e.g. alkyl benzene sulfonates, alkyl ether sulfates, alkyl sulfonates, ethoxylates and/or propoxylates of fatty alcohols, alkyl phenols, fatty acids or fatty acid amides.

Perfuming agents, optical brighteners, antioxidants.

The surfactants and additional densitizing agents can be present in amounts up to 20% by weight, the other additives generally under 1% by weight, each in relation to the suspension. An expert can form a picture by means of orienting storage tests whether and to what extent he can add the intended additives to the suspensions of the invention without adversely affecting their chemical and physical stability.

As has already been stated, the bleaching agent suspensions of the invention are physically and chemically storage-resistant for several weeks and thus permit a safe handling during storage, transport and use. A phase separation, floating or settling of the solid or inhomogeneities within the suspension such as those which occur in previously known bleaching agent suspensions after only a brief storage time do not generally appear in the suspensions of the invention. In the rare instances in which they occur after several weeks, they can be easily reversed. As a result of the presence of the hydrateforming desensitizing agent, a dried bleaching agent suspension also remains safe.

The bleaching agent suspensions of the present invention are prepared by means of homogeneously suspending the water-insoluble peroxycarboxylic acid in an aqueous carrier liquid containing a xanthan polysaccharide or agar polysaccharide. A hydrateforming neutral salt and an acidifying agent are added to this carrier liquid before, during or after the addition of the peracid. It is preferable to dissolve the thickening agent, optionally at an elevated temperature, in the carrier liquid and then add the other obligatory and optionally helpful components to the bleaching agent suspension and homogenize the mixture using shearing forces, e.g. by means of intensive stirring or shaking. A propeller agitator with a stirring speed of approximately 1,000–2,000 rpms and a stirring time between 5 and 20 minutes are generally suitable for homogenization. The components are added in the amounts cited above.

According to a preferred embodiment, a peroxycarboxylic acid, hydrophilized in the presence of a strong acid and optionally also densensitizing agent is a hydrateforming neutral salt and the acidifying agent carries over from the hydrophilizing and/or desensitizing stage. It is especially advantageous to add a non-dried hydrophilized peroxycarboxylic acid with the associated acidifying agent derived from its preparation and with associated moisture and a hydrate-forming neutral salt present which optionally derives from the desensitizing. The last-named preferred embodiments are distinguished by the easy wettability of the per compound, the increased storage resistance of the resulting bleaching agent suspension and above all by the simple and safe preparation of the suspension - simple because a peroxycarboxylic acid containing an acidifying agent and neutral salt is added into the thickened carrier liquid and safe because the peroxycarboxylic acid is not sensitized at any time, nor does it have to be dried at any time.

The bleaching agent suspensions of the invention can be added as a washing bleach in combination with washing agents. Tea spots, coffee spots and other spots are removed from textiles, e.g. during washing at 20° to 60° C., if a bleaching agent suspension of the invention is added to an alkaline washing liquid containing conventional washing agent components, especially wash-active surfactants, inorganic polyphosphate builders and/or zeolite builders, organic chelating agents, sodium silicate, alkalis and sodium sulfate. The bleaching agent suspension is added to the washing liquid in such an amount that the available oxygen which can be released from the peroxycarboxylic acid amounts to 1 to 100 ppm. The washing agent components are dissolved and distributed in an even manner in a concentration in the washing liquid which is customarily effective for washing.

The bleaching agent suspensions can also be used as bleaching boosters and for preparing cleaning agents and disinfecting agents.

The following examples clarify the invention.

Preparation of the bleaching agent suspension was carried out using the following general procedure:

The carrier liquid, water in the examples, is placed in a 250 ml glass beaker equipped with a threeblade propeller agitator. After the thickening agent or surfactant has been added and dissolved, the peroxycarboxylic acid and the other components are added and homogeneously suspended by intensive stirring. The diperoxydodecanedioic acids (DPDDA) added were prepared, to the extent not indicated otherwise, according to German Patent specification DE-OS No. 33 20 497 (hydrophilized DPDDA) or DE-OS No. 33 20 496 (desensitized, hydrophilized DPDDA).

In order to test its physical stability, the suspension is transferred into a graduated 100 ml cylinder and stored at room temperature. Instabilities during storage can be noticed as a phase containing little or no solid material, whereby this phase can occur "at the top", "at the bottom" or as a "gap" within the 100 ml layer. The chemical stability is determined by iodometric or potentiometric titration. The latter permits detection of both the peracid and the carboxylic acid which forms its base and is produced during the breakdown of the peracid.

EXAMPLE 1

(Reference Example)

Bleaching agent suspensions analogous to those described in European Patent Specification EP-A No. 0,176,124 containing 13.3 or 25% by weight diperoxydodecanedioic acid (DPDDA) and sodium alkyl benzene sulfonate (Maranil$^R$ A by Henkel KGaA, Dusseldorf or Marlon$^R$ A 390 by Chemische Werke Huls, Marl). "Nondried DPDDA" with a content of 61.9% by wt. DPDDA and 24.3% by wt. $Na_2SO_4$ (Examples 1A and 1B) and "dried DPDDA" extracted from it by drying at 30° C. in a vacuum with 68.5% by wt. DPDDA and 26.9% by wt. $Na_2SO_4$ were suspended. The acidifying agent from the preparation and desensitizing according to DE-OS No. 33 20 496 were carried over.

| Suspensions (Additives in g per 150 g suspension) | A | B | C |
|---|---|---|---|
| "Non-dried DPDDA | 32.2 | 32.2 | — |
| "Dried DPDDA" | — | — | 54.8 |
| Maranil ® A | 9 | — | — |
| Marlon ® A | — | 9 | 0.8 |
| Turpinal ® SL* | — | 1.3 | 1.3 |
| $Na_2SO_4$ (additional) | 17.5 | 17.5 | — |
| Water | 91.3 | 90 | 93.7 |
| Suspending (min/rpms) | 10/2000 | 10/2000 | 10/2000 |
| pH of the suspension | 3.6 | 3.5 | 3.8 |
| Physical** stability | | | |
| after 1 hour | gap at 5-20 ml | gap at 8-15 ml | above 20 ml |
| after 1 day | gap at 9-38 ml | gap at 5-35 ml | |

*60% hydroxyethylidene diphosphonic acid of Henkel KGaA, Dusseldorf.
**Depth of bed 18.5 cm altogether.

EXAMPLE 2

(Reference Example)

Bleaching agent suspensions analogous to those described in British Patent No. 1,535,804 containing 25% by wt. DPDDA and 0.1 or 0.5% by wt. gum arabic (Example 2A and 2B) and 0.5% by wt. carboxypolymethylene (Carbopol$^R$ of the B.F. Goodrich Co. (Example 2C and 2D). The same "dried DPDDA" as in Example 1 was added, suspension was stirred 10 minutes at 2000 rpms.

| Suspension (Data in % by wt.) | 2A | 2B | 2C | 2D |
|---|---|---|---|---|
| DPDDA | 25 | 25 | 25 | 25 |
| $Na_2SO_4$ | 10 | 10 | 10 | 10 |
| Gum arabic | 0.1 | 0.5 | | |
| Carbopol ® 934 | — | — | 0.5 | — |
| Carbopol ® 941 | — | — | — | 0.5 |
| pH | 3.8 | 3.7 | 3.7 | 3.7 |
| Physical stability | | | | |
| after 1 hour | bottom/ 10 ml | bottom 1 ml | top/ 1 ml | stable |
| after 1 day | bottom/ 20 ml | gap at 50-60 ml | top/ 7 ml | bottom 15 ml |

Neither in the case in which Carbopol$^R$ materials are used, nor in the case of using gum arabic, does the use of hydrophilized peroxycarboxylic acid desensitized with $Na_2SO_4$ produce sufficient stability of the suspension.

EXAMPLE 3

Bleaching agent suspensions in accordance with the invention containing 25% by wt. DPDDA and xanthan (KELZAN of Kelco Co., Oklahoma, USA). The desensitized, "dried DPDDA" according to Example 1 was added. Xanthan was dissolved prior to the addition of the peracid with heating. The mixture was suspended during 10 minutes at 2000 rpms at 20° C. The depth of bed in a graduated cylinder was 18.5 cm.

| Suspension (Components in % by wt.) | 3A | 3B | 3C | 3D |
|---|---|---|---|---|
| DPDDA | 25 | 25 | 25 | 25 |
| $Na_2SO_4$ | 10 | 10 | 10 | 10 |
| xanthan | 0.1 | 0.3 | 0.5 | 0.5 |
| hydroxyethylidene diphosphonic acid | — | — | — | 0.5 |

-continued

| Suspension (Components in % by wt.) | 3A | 3B | 3C | 3D |
|---|---|---|---|---|
| pH | 3.6 | 3.6 | 3.6 | 3.5 |
| Physical stability | | | | |
| after 1 day | 1 ml/top | stable | stable | stable |
| after 7 days | 3 ml/top | stable | stable | stable |
| after 14 days | 3 ml/top | 1 ml/top | stable | stable |
| after 25 days | | 2 ml/top | 1 ml/top | stable |
| after 53 days | | | | stable |
| Chemical stability (% by wt. DPDDA) | | | | |
| after 1 hour | | | 25.3 | 24.6 |
| after 14 days | | | 24.6 | 24.3 |
| after 36 days | | | | 24.4 |
| after 109 days | | | 24.1 | 24.1 |

The chemical stability is distinctly increased by the complexing agent: Practically no volumetric expansion. As a result of gas bubbles which formed and adhered to the solid matter, the volume in Examples 3A and 3B increased by approximately 2% per week, in example 3C by approximately 1.5% per week.

EXAMPLE 4

25% by wt. DPDDA suspensions were prepared in a 2-liter beaker glass in a known manner. However, the suspensions were suspended with a crescent-shaped agitator for 15 minutes at 1300 rpms. Xanthan was first dissolved in hot water; after having cooled down, the suspension was prepared, and non-dried and dried, densensitized, hydrophilized DPDDA were added.

| Suspension | A | B |
|---|---|---|
| "Dried DPDDA" with 70% by wt. DPDDA and 26% by wt. $Na_2S0_4$ | 429 g | — |
| "Non-dried DPDDA" with 61% by wt. DPDDA and 22.5% by wt. $Na_2S0_4$ | — | 492 g |
| xanthan | 6 g | 6 g |
| Turpinal SL (Henkel KGaA, Dusseldorf) (approx 60% hydroxyethylidene diphosphonic acid) | 10 g | 10 g |
| Water | 755 g | 755 g |
| pH of the suspension | 3.8 | 3.6 |
| Physical stability (12 cm - high layer in a reagent bottle) | | |
| after 1 week | stable ↓ | stable |
| after 2 weeks | increasing ↓ | stable |
| after 4 weeks | sedimen- ↓ | stable |
| after 6 weeks | tation ↓ | stable |

Suspension B had a liquid limit of 11 Pa, exhibited structural viscous flow behavior with weakly expressed thixotropy; viscosity 40 mPa.s at 50/s.

EXAMPLE 5

A suspension was prepared as usual from 39.5 g DPDDA (with a content of 95% DPDDA, 4% dodecanedioic acid and 1% residual moisture), 0.4 g xanthan, 14 g $Na_2SO_4$ and 96.5 g water; the pH ws adjusted to 4.5 by adding $H_2SO_4$. The suspension exhibited no change within two weeks.

EXAMPLE 6

Bleaching agent suspension according to the invention, containing 25% by wt. DPDDA and 0.1 or 0.2% by wt. agar-agar as thickening agent. Preparation of the suspension according to the general procedure; suspended at 20° C. with propeller agitator, 10 minutes, 2000 rpms.

| Suspensions (components in % by wt.) | 5A | 5B | 5C |
|---|---|---|---|
| DPDDA (76%)[1] | 25 | 25 | — |
| DPDDA (68.5%)[2] | — | — | 25 |
| agar-agar | 0.1 | 0.2 | 0.2 |
| Hydroxyethylidene diphosphonic acid | — | — | 0.5 |
| Physical stability | | | |
| After 1 day | stable | 1 ml/top | stable |
| After 8 days | gap at 6–10 ml | 2 ml/top | 2 ml/top |
| After 14 days | gap at 7–14 ml | 2 ml top | 2 ml top |
| After 32 | | | 3 ml top |
| After 53 | | | 4 ml top |
| (Depth of bed 18.5 cm) | | | |

[1]Dried, desensitized, hydrophilized DPDDA with 76% by Wt. DPDDA and approximately 20% by wt. $Na_2SO_4$ were added.
[2]"Dried DPDDA" according to example 1 was added.

What is claimed is:

1. A storage-resistant, pourable to pasty aqueous bleaching agent suspension having a pH between approximately 1 and approximately 6 comprising an aqueous carrier liquid, a particulate, substantially water-insoluble peroxycarboxylic acid, an organic thickening agent, an acidifying agent and a hydrate-forming neutral salt which densensitizes peroxycarboxylic acids, the thickening agent comprising a xanthan polysaccharide or agar polysaccharide.

2. A bleaching agent suspension as set forth in claim 1 which contains 0.01 to 5.0% by wt., of a xanthan polysaccharide in relation to the bleaching agent suspension and in which the carrier liquid consists of 90 to 100% by wt. water and 0–10% by wt. of an organic solvent.

3. A bleaching agent suspension as set forth in claim 2 which contains 0.5 to 2% by wt. of a xanthan polysaccharide in relation to the bleaching agent suspension.

4. A bleaching agent suspension as set forth in any one of claims 1–3 which contains a hydrate-forming neutral salt of a metal selected from the group consisting of the alkali metals, magnesium and aluminum with an acid selected from the group consisting of sulfuric acid, pyrosulfuric acid, phosphoric acid, pyrophosphoric acid or tripolyphosphoric acid, in an amount of 1 to 40% by wt., calculated hydrate-free and in relation to the bleaching agent suspension.

5. A bleaching agent suspension according to any one of claims 1 to 3 which contains sulfuric acid an alkali metal hydrogen sulfate as acidifying agent and which contains an alkali metal sulfate as hydrate-forming neutral salt.

6. A bleaching agent suspension as set forth in any one of claims 1 to 3 which 1 to 40% by wt. peroxycarboxylic acid in relation to the bleaching agent suspension.

7. A bleaching agent suspension as set forth in claim 6 which contains 5–30% by wt. peroxycarboxylic acid in relation to the bleaching agent suspension.

8. A bleaching agent suspension as set forth in any one of claims 1 to 3 which contains an aliphatic or aromatic diperoxydicarboxylic acid which contains 8 to 14 carbon atoms.

9. A bleaching agent suspensions as set forth in anyone of claims 1 to 3 which additionally contains other neutral, acidic desensitizing agents, chelating agents, stabilizers, a member of the group consisting of anionic and non-ionic surfactants 10. A bleaching agent as set forth in claim 9 in which the desensitizing agent is boric acid.

11. A bleaching agent as set forth in claim 9 in which the chelating agents is selected from the group consisting of N-methylene phosphonate-substituted alkylene polyamines.

12. A bleaching agent as set forth in claim 9 in which the stabilizer is selected from the group consisting of dipicolinic acid and trialkyl phosphane oxides.

13. A bleaching agent suspension as set forth in any one of the claims 1 to 3 which contains 10 to 30% by wt. diperoxydodecanedioic acid, 5–20% by wt. sodium sulfate and 0.1–1% by wt. xanthan, each in relation to the bleaching agent suspension, and sulfuric acid, sodium hydrogen sulfate and mixtures thereof as acidifying agent.

14. A bleaching agent suspension as set forth in any one of claims 1 to 3 which contains a peroxycarboxylic acid hydrophilized in the presence of a strong acid.

15. A bleaching agent as set forth in claim 14 in which the hydrophilized peroxycarboxylic acid is obtainable during the preparatio of peroxycarboxylic acid from the base acid or its anhydride and hydrogen peroxide in the presence of sulfuric acid.

16. A method for preparing a bleaching agent suspension according to any one of claims 1 to 3 which comprises homogeneously suspending a particulate, substantially waterinsoluble peroxycarboxylic acid in an aqueous carrier liquid containing a xanthan polysaccharide or agar polysaccharide as an organic thickening agent, an acidifying agent and additives, and adding a hydrate-forming neutral salt which desensitizes peroxycarboxylic acids to the carrier liquid before, during or after the addition of the peroxycarboxylic acid to the carrier liquid.

17. A method as set forth in claim 16 in which the carrier liquid consists of 90–100% by wt. water and 10 to 0% by wt., in relation to the weight of the carrier liquid, of an organic solvent, 0.1 to 5% by wt., of a xanthan polysaccharide, in relation to the bleaching agent suspension, is dissolved in the carrier liquid, the peroxycarboxylic acid, the hydrate-forming neutral salt and the acidifying agent are added into the solution thickened in this manner and in which the substantially water-insoluble peroxycarboxylic acid and the undissovled neutral salt are homogeneously suspended.

18. A method as set forth in claim 17 in which the amount of xanthan polysaccharide is 0.05 to 2% by weight of the bleaching agent suspension.

19. A method as set forth in claim 16 in which a peroxycarboxylic acid is added which was hydrophilized in the presence of a strong acid and optionally desensitized.

20. A method as set forth in claim 19 in which the hydrophilized peroxycarboxylic acid is added with acidifying agent stemming from its preparation and with moisture.

21. A bleaching agent comprising the suspension set forth in any one of claims 1 to 3 in combination with detergent or washing agents.

22. A method as set forth in claim 20 with hydrate-forming neutral salt present stemming from the desensitizing.

* * * * *